United States Patent [19]

Sindermann

[11] 4,404,912

[45] Sep. 20, 1983

[54] CHAFF CARTRIDGE FOR AIRCRAFT DEFENSE

[75] Inventor: Paul Sindermann, Nuremberg, Fed. Rep. of Germany

[73] Assignee: Diehl GmbH & Co., Nuremberg, Fed. Rep. of Germany

[21] Appl. No.: 249,123

[22] Filed: Mar. 30, 1981

[30] Foreign Application Priority Data

Apr. 24, 1980 [DE] Fed. Rep. of Germany ..... 3015719

[51] Int. Cl.[3] ..... F42B 9/02

[52] U.S. Cl. ..... 102/505; 124/57; 343/18 E

[58] Field of Search ..... 124/57; 46/38; 102/357, 102/450, 451, 505; 343/18 E

[56] References Cited

U.S. PATENT DOCUMENTS

| | | | |
|---|---|---|---|
| 2,375,314 | 5/1945 | Mills | 124/57 |
| 2,964,031 | 12/1960 | Dotson | 124/57 |
| 3,064,575 | 11/1962 | Schermuly | 102/357 |
| 3,095,814 | 7/1963 | Jansen et al. | 102/505 X |
| 3,289,586 | 12/1966 | Horn et al. | 102/450 |
| 3,596,599 | 8/1971 | Schillreff | 102/357 X |
| 3,674,174 | 7/1972 | Crewe | 102/505 X |
| 3,741,125 | 6/1973 | La Pointe | 102/505 X |
| 3,830,214 | 8/1974 | Curtis | 124/57 |
| 4,333,402 | 6/1982 | Landstrom et al. | 343/18 E X |

FOREIGN PATENT DOCUMENTS 7826530 4/1980 France .

*Primary Examiner*—Richard T. Stouffer

*Attorney, Agent, or Firm*—Scully, Scott, Murphy and Presser

[57] ABSTRACT

An ejection device in the form of a chaff cartridge for dipoles for aircraft defense, through disorientation of the hostile aircraft cannon radar. The ejection device allows for the dipoles to be completely ejected and wherein, after the ejection, the individual dipoles are uniformly dispersed to provide for the formation of a homogeneous cloud. In order to obtain the foregoing pistons of the device are provided with sealing rings, and include guide surfaces which extend in the axial direction of the shell and which conform to the shell. Advantageous hereby is the uncomplicated and inexpensive construction of the pistons from sprayed plastic material parts, and wherein the sealing rings additionally serve as tolerance compensators between the otherwise expanding shell with regard to the pistons.

10 Claims, 6 Drawing Figures

CHAFF CARTRIDGE FOR AIRCRAFT DEFENSE

BACKGROUND OF THE INVENTION

1. Field of the Invention

The present invention relates to an ejection device in the form of a chaff catridge for dipoles for aircraft defense, through disorientation of the hostile aircraft cannon radar.

2. Discussion of the Prior Art

It is known from German Laid-open Patent Application No. 27 22 812 to eject metallized glass fibers, referred to as dipoles, from a shell, by means of which the hostile radar is disrupted or disoriented. The ejection device consists of a mechanically-driven plunger which propels dipoles arranged within packages from the shell.

In accordance with a state of the technology which until the present has not been disclosed in the literature, it is known that the dipoles are ejected from a shell having a rectangular cross-section through the intermediary of a piston and an electrically-detonatable pressured gas catridge. Through experiments it has been determined that an optimum distribution of the dipoles within the air is only attainable when the dipoles which are packed in the shell are sealed against moisture and, as is naturally understandable, are completely ejected out of the shell. In the mentioned dipole cartridge there is not provided a moisture-sealed storage of the dipoles. In the shell, which is open at both ends thereof, the dipole charge is arranged intermediate two pistons. Air gaps are present between the piston and the walls of the shell through which the moisture can readily penetrate into the dipole charge. Moist dipoles will, accordingly, stick to each other and will not distribute themselves to the necessary extent after ejection. The piston which is associated with the pressurized gas catridge, as well as the piston at the ejection end, are provided with relatively small side guide surfaces so that the pistons will merely tip due to the gas pressure rather than maintaining their position relative to the axial extension of the shell. Thereby, during ejection, the dipoles which are located within the so-called "piston blind zone" will remain within the shell.

SUMMARY OF THE INVENTION

Accordingly, it is an object of the present invention to propose an ejection device which allows for the dipoles to be completely ejected and wherein, after the ejection, the individual dipoles are uniformly dispersed to provide for the formation of a homogeneous cloud. In order to obtain the foregoing, the pistons of the device are provided with sealing rings, and include guide surfaces which extend in the axial direction of the shell and which conform to the shell. Advantageous hereby is the uncomplicated and inexpensive construction of the pistons from sprayed plastic material parts, and wherein the sealing rings additionally serve as tolerance compensators between the otherwise expanding shell with regard to the pistons.

Pursuant to another feature of the invention there is afforded that piston at the side of the pressurized gas charge will, at the point in time of the maximum gas pressure, be conducted centrally through the cylindrical surfaces extending in the axial direction of the shell. This will eliminate the danger that this piston will be already tilted to some extent during the initial phase of its movement and would more extensively tip during continued travel.

Pursuant to another feature of the invention, there is provided a dual guidance for the piston at the side of the charge or load. For this purpose, the wall of the detonating cartridge aids in the guidance of the piston.

Additionally, the invention also provides for the features that the ejecting power of the pressurized gas catridge is only insignificantly reduced since the sealing rings tending to reduce this ejecting power are only in short engagement during the piston movements.

In accordance with another feature of the present invention, the piston is inexpensively manufactured and constructed with only a low mass so that the force required for the ejection of this piston is relatively small. Moreover, this piston allows that, upon the dropping of the ejection device against this piston, the impact energy is dampered by the edge of the piston and the piston will not vary its position relative to the shell.

Pursuant to another feature of the present invention the ejection sequence of the dipoles is improved in that legs which encompass the dipoles will carry these dipoles far out of the firing range whereby the dipoles will be immediately dispersed in a zone of greater air flow so that the cloud formation commences immediately after the ejection and the degree of distribution is significantly improved.

Through the advantageous length of the legs there is provided an equilibrium between a high degree of dispersion for the dipoles and the utilized ejection force by the piston which is extended by the legs with an increased friction value within the shell.

The sealing of the dipole charge at the detonation side and of the pressurized gas cartridge is improved by the present invention so as to achieve the advantage that, upon insertion of the pressurized gas cartridge, the piston remains free of any pushing forces. The charged pressurized gas cartridge is inserted into the ejection device in conformance with the number of aircraft take-offs and it is again removed upon landing.

Moreover, the sealing ring seals towards the rear upon detonation of the pressurized gas cartridge so that the gas pressure is unable to fully act on the piston and there is thus affored a troublefree operation.

An immediate ejection of the piston at the mouth side of the shell and an almost compression-free discharge of the dipoles is afforded by the leg structure on the piston at the detonation side. The dipole charges are almost completely encompassed by the overlong leg structure on the piston at the detonation side, so that during the acceleration of the piston at the detonation side the legs will eject the piston at the mouth of the shell. A compression of the dipoles through the eventually to be fixedly seated piston at the detonation side is precluded.

Moreover, there is also provided a mandrel so as to, in the same manner as mentioned hereinabove, provide for an almost compressionless discharge of the dipoles. However, the dispersion of the dipoles in order to form a "cloud" is improved in that, through the central storage of the dipole charges, the air vortices will in an essentially unhindered manner detach the dipoles from the charges or packages.

BRIEF DESCRIPTION OF THE DRAWINGS

Reference may now be had to exemplary embodiments of the invention, taken in conjunction with the accompanying drawings; in which.

DETAILED DESCRIPTION

Figure 1:
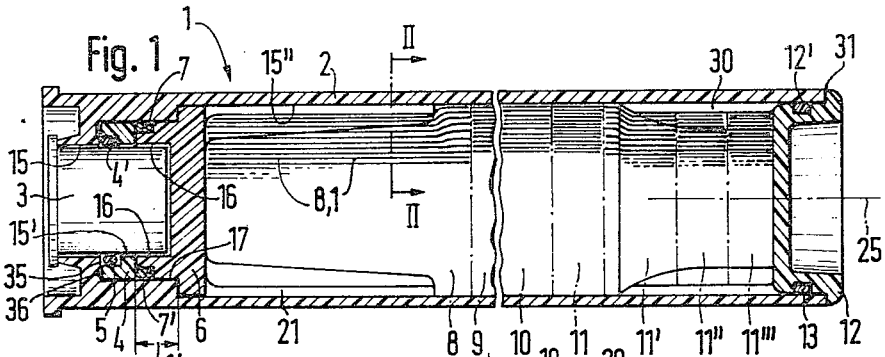
FIG. 1 illustrates a longitudinal sectional view through an injection device for dipoles.
Figure 2:
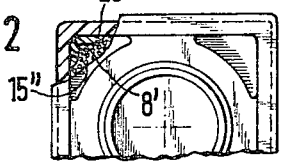
FIG. 2 shows a left end side view, partly in section, of FIG. 1.

An ejection device 1 for, only exemplary drawn, dipoles 8' consists of a shell 2 having an essentially rectangular cross-section, a pressurized gas charge cartridge 3, a spacer ring 4 at the charge side having a groove 4' and a rubber-elastic sealing ring 5, a piston 6 on the charge side with a single-piece leg structure 21, sealing ring 7 and groove 7', dipole charges 8–11''', and piston 12 at the ejection side with a single-piece leg structures 30, groove 12' and rubber-elastic sealing ring 13.

The gas-charged cartridge 3 is plugged into cylindrical openings or recesses 15, 15', 16 in the shell 2, spacer ring 4 and piston 6. Thereby, the pressurized gas charge cartridge 3 centers the piston 6 along the sliding path 14 of the sealing ring 7 within the cylindrical guide 17 of the shell 2. During further travel, the cornered side surfaces 20 and the four leg structures 21 which are located in the corners of the shell 2, center the piston 6 in the inner space 15'' having a rectangular cross-section.

Figure 3:
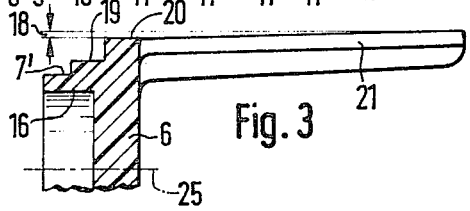
FIG. 3 illustrates the piston at the gas pressure side of FIG. 1 on an enlarged scale.

The leg structures 21 of the piston 6, pursuant to FIG. 3, diverge relative to the shell axis 25 by an extent 18 so that they lie clamped in the corners 26 of the shell 2. These leg structures 21, as well as the leg structures 30 of the piston 12, encompass a part of the dipole charges, in essence, to a greater part the charges 8, 11', and 11'', 11''' completely. The spacer ring 4 evidences an angled profile and supports the sealing ring 5 whereby the shell bottom 35 and the spacer ring 4 form the end wall contact surfaces for the sealing ring 5. The spacer ring 4 is fixedly connected with the shell bottom 35 through adhesive or welding at location 36.

Inasmuch as the hygroscopic pressurized gas charged cartridge 3 at the firing side is frequently inserted into and again removed from the ejection device, through the spacer ring 4 with the sealing ring 5, there is afforded that, upon insertion of the pressurized gas cartridge 3 into ejection device 1, the piston 6 will remain free of froces so as to maintain its position and the dipoles will not be impermissibly compressed (tendency of forming clumps), in that the hygroscopically sensitive mouth opening of the pressurized gas cartridge 3 is sealed in order to be sealed against moisture, and that upon ejection of the charges 8 through 11''' no gas will escape rearwardly.

At the detonation or ignition of the rearwardly stopped-up gas-charged cartridge 3 in a manner not shown herein, the gas pressure drives the piston 6 with its cylindrical extension 19 out of the cylindrical guide 17 of the shell 2 whereby, through the cylindrical guidance of the piston 6 along the cartridge 3 and over the contact surface 17 of the sliding path 14, there is securely prevented any tipping of the piston 6. During this short piston movement there occurs a minor compressing of the dipole charges 8 through 11''', and there commences the ejection of the piston 12 and the above-mentioned dipole charges. Due to the further axial conveyance, the side walls 20, in combination with the rectangular inner space 15'', or inner wall 9 and the leg structures 21, 30, assume the guidance of the dipole charges 8 through 11''' while maintaining the right-angled position of the pistons 6, 12 relative to the shell axis 25.

In conformance with the acceleration of the piston 12, the dipole charges 11' to 11''' which are engaged by the leg structures 30 are conducted relatively far away from the mouth 31 of the shell 2 so that there is present an already good initial dispersion of the dipoles. Following in sequence are then the further "unguided" dipole loads or charges 9, 10, 11. As the last "guided" charge there follows the dipole load 8 together with the piston 6 whereby there is also effected a further discharge conforming to the discharge of the dipole charges 11' through 11'''.

The sealing rings 7 and 13 provide for the moisture-sealed storage of the dipole charges 8 through 11'''.

Figure 4:
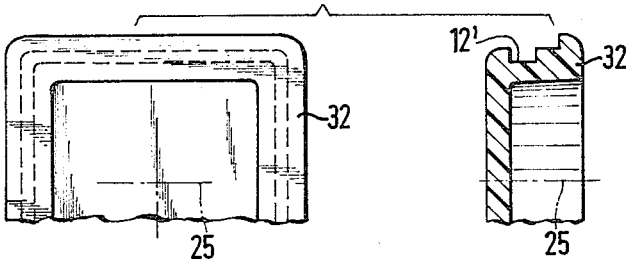
FIG. 4 shows a modified embodiment of the piston at the ejection side pursuant to FIG. 1 on an enlarged scale.

Pursuant to FIG. 4 there is illustrated a piston 32. The piston corresponds to the piston 12 illustrated in FIG. 1, however, it does not include any leg structures.

Figure 5:
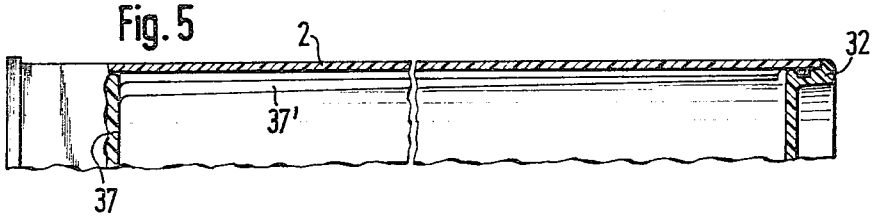
FIG. 5 shows a portion of another embodiment of an ejection device modified relative to that shown in FIG. 1.

According to FIG. 5, inserted into the shell 2 pursuant to FIG. 1 is a piston 37 with four leg structures 37', and the piston 32.

Figure 6:
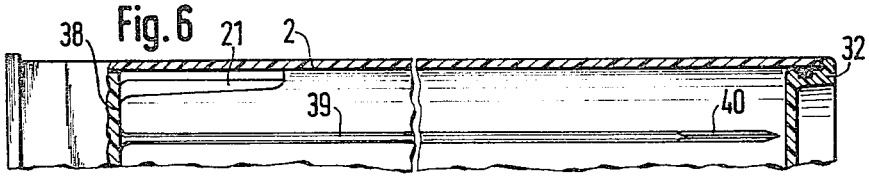
FIG. 6 illustrates another embodiment of the ejection device.

Pursuant to FIG. 6, the piston 38 with the leg structures 21 has a mandrel 39 with a grooved tip 40 attached thereto. This tip 40 renders easier the mounting on of the charges 8 through 11''' which are separated by metal foils (not shown).

The described components 2, 4, 6, 12, 32, 37 and 38 consist of a viscous-elastic plastic material, such as polyamide, having a high impact resistance and good ability to withstand cold.

In addition to above-described rectangular cross-section for the shell 2 it is also possible to have other cross-sectional configurations, such as circular cross-section, or a polygonal cross-section with rounded-off corners.

What is claimed is:

1. A cartridge for ejecting chaff dipoles for use in an aircraft defense system to disrupt enemy radar, said cartridge comprising:

(a) a shell for receiving a plurality of chaff dipoles, said shell having a base portion and an open mouth portion;

(b) a plurality of chaff dipoles, said dipoles having at least first and second portions;

(c) a pressurized gas cartridge mounted in the base of the cartridge for expelling said dipoles through said open mouth portion;

(d) a first piston means mounted between said gas cartridge and said chaff dipoles, said first piston means having axially and forwardly extending spaced apart leg means that contact the inner walls of said cartridge and a portion of said dipoles, said piston and leg means retaining said first portion of chaff dipoles in their initial loaded position for a predetermined portion of their flight path after ejection;

(e) a second piston means closing the mouth of said cartridge, said second piston having rearwardly and axially extending leg means for retaining said second portion of the dipoles after ejection:

whereby the pressurized gas ejects the first piston, the chaff dipoles and said second piston to form an elongated pattern of dispersion a predetermined distance from said aircraft.

2. A cartridge for ejecting chaff dipoles for use in an aircraft defense system to disrupt enemy radar, said cartridge comprising:

(a) a shell for receiving a plurality of chaff dipoles, said shell having a base portion and an open mouth portion;

(b) a plurality of chaff dipoles, said dipoles having at least first and second portions;

(c) a pressurized gas cartridge mounted in the base of the cartridge for expelling said dipoles through said open mouth portion;

(d) a first piston means mounted between said gas cartridge and said chaff dipoles, said first piston means having axially and forwardly extending narrow leg means that are spaced generally the width of the individual legs;

(e) a second piston means closing the mouth of said cartridge:

whereby the pressurized gas ejects the first piston, the chaff dipoles and said second piston to form an elongated pattern of dispersion a predetermined distance from said aircraft.

3. A cartridge for ejecting chaff dipoles for use in an aircraft defense system to disrupt enemy radar, said cartridge comprising:

(a) a shell for receiving a plurality of chaff dipoles, said shell having a base portion and an open mouth portion;

(b) a plurality of chaff dipoles, said dipoles having at least first and second portions;

(c) a pressurized gas cartridge mounted in the base of the cartridge for expelling said dipoles through said open mouth portion;

(d) a first piston means mounted between said gas cartridge and said chaff dipoles, said first piston means having axially and forwardly extending spaced apart leg means that contact the inner walls of said cartridge and a portion of said dipoles, said piston and leg means retaining said first portion of chaff dipoles in their initial loaded position for a predetermined portion of their flight path after ejection;

(e) a second piston means closing the mouth of the cartridge;

(f) a mandrel mounted in the center of the first piston, said mandrel extending through said dipoles generally the length of said cartridge;

whereby the pressurized gas ejects the first piston, the chaff dipoles, and the second piston to form an elongated pattern of dispersion a predetermined distance from said aircraft.

4. A device as claimed in claims 1 or 2 or 3 wherein said first piston means at the base of the shell further comprises a cylindrical extension for guidance and sealing in said shell, said extension being mounted in a cylindrical guide formed in the base of said shell.

5. A device as claimed in claim 4, wherein said extension further includes a cylindrical recess for receiving a portion of said gas cartridge.

6. A device as claimed in claim 4, which further comprises a groove formed in said extension at a mouth of said recess for receiving a sealing ring.

7. A device as claimed in claim 2 or 3, wherein said second piston in the mouth of said shell is cup-shaped and defines a groove adjacent said mouth for receiving a sealing ring.

8. A device as claimed in claim 1 or 2 or 3, said forwardly extending leg means clampingly contacting an inner wall defined by said shell.

9. A device as claimed in claim 8, wherein the length of the forwardly extending leg means generally corresponds to the shell cross-section.

10. A device as claimed in claim 1 or 2 or 3, which further comprises a spacer ring mounted in said shell between the first piston and the shell base portion, said ring having a groove formed therein for receiving a sealing ring.

* * * * *